US007153022B2

(12) United States Patent
Dear

(10) Patent No.: US 7,153,022 B2
(45) Date of Patent: Dec. 26, 2006

(54) SOLAR POWERED RAINBOW MAKER

(76) Inventor: David I. Dear, 283 Ave. C, Apt. 7H, New York, NY (US) 10009

( * ) Notice: Subject to any disclaimer, the term of this patent is extended or adjusted under 35 U.S.C. 154(b) by 493 days.

(21) Appl. No.: 10/207,584

(22) Filed: Jul. 29, 2002

(65) Prior Publication Data

US 2004/0017338 A1 Jan. 29, 2004

(51) Int. Cl.
*G04B 17/02* (2006.01)

(52) U.S. Cl. ..... 368/180; 368/134; 368/327

(58) Field of Classification Search ..... 362/183, 362/405, 811; 40/473, 430, 470; 368/180; 446/175; 74/413, 416, 421 A
See application file for complete search history.

(56) References Cited

U.S. PATENT DOCUMENTS

| | | | | |
|---|---|---|---|---|
| 4,764,850 | A | 8/1988 | Albaneese | |
| 5,222,805 | A * | 6/1993 | Schonbek et al. | 362/405 |
| 5,232,105 | A | 8/1993 | Greg | |
| 5,237,764 | A * | 8/1993 | Gray | 40/473 |
| 5,247,491 | A | 9/1993 | Kwiatkowski | |
| 5,579,163 | A | 11/1996 | Peterson | |
| 5,718,962 | A | 2/1998 | Walling | |
| 6,250,798 | B1 * | 6/2001 | Brainard et al. | 368/180 |
| 6,592,423 | B1 * | 7/2003 | Boyle et al. | 446/175 |
| 6,644,139 | B1 * | 11/2003 | Liu | 74/421 A |

FOREIGN PATENT DOCUMENTS

GB 2074770 A * 11/1981

OTHER PUBLICATIONS

Radin, Shelden H., Physics for Scientists and Engineers, By Prentice-Hall Inc. , 1982, pp. 727-728.*

* cited by examiner

*Primary Examiner*—Sandra O'Shea
*Assistant Examiner*—Anabel Ton
(74) *Attorney, Agent, or Firm*—Richard L. Strauss, Esq.

(57) ABSTRACT

A crystal display device is disclosed wherein a vertically arranged photovoltaic cell, main device housing—encasing an electric motor and transmission—, and a refractory crystal suspended below is rotated so as to provide multi-colored displays upon room walls and other surfaces when exposed to sunlight. A preferred embodiment of the device utilizes a suction cup to retain the device housing in the afore-mentioned vertical alignment against the inside of a selected window.

30 Claims, 6 Drawing Sheets

SOLAR POWERED RAINBOW MAKER

TECHNICAL FIELD

The present invention relates to motorized refractory display devices. More specifically, the present invention discloses a novel and highly effective solar powered refractory device.

BACKGROUND OF THE INVENTION

Refractory materials have often been utilized in order to provide decorative displays. Such materials may be of a natural origin such as, for example, quartz crystals, or may be comprised of synthesized compounds demonstrating desired refractory properties. All such materials, regardless of composition, require a source of light to be refracted into a decorative spectrum of color. When the light source utilized is fixed in position, the refractory material may be rotated so as to provide an optimal angle of incidence with such a source, as well as to provide both movement and variety in the resultant mufti-color displays.

In the past, electric motors have been utilized to rotate refractory materials in order to provide a multi-colored display which generates light patterns of varying colors. For example, U.S. Pat. No. 4,764,850 discloses a device wherein an electric motor, powered by means of a photovoltaic cell, is utilized to rotate a generally diamond shaped leaded glass crystal. The crystal is selected to demonstrate a tapered lower end and different-sized facets so as to provide different angles for refraction of sunlight striking the crystal. Since the crystal is radially symmetric—as opposed to having a flattened or otherwise asymmetric cross-sectional conformation—the crystal continuously rotates adjacent facets into incident light.

The crystal utilized in the '850 patent is mounted upon a cup shaped receptacle which, in turn, is mounted upon a drive shaft extending above the device housing. When the device is exposed to sunlight, the diamond shaped crystal is rotated so as to refract the light into a "series of spots or patterns of different colors or hues across the walls or ceiling of the room, thus forming an aesthetically appealing display." (col. 3, lines 41–43 of the '850 patent). The solar powered motor drive unit described in the '850 patent provides, by means of a gear drive system, rotation of the tapered crystal at a speed of from 2 to 3 rpm so that adjacent facets of the tapered crystal are repeatedly exposed to incident light. However, the radially symmetric shape of the disclosed crystal would not be expected to provide for effective movement of a particular projection, such as, for example, a rainbow, across a wall or other surface due to the fact that the radially symmetry of the crystals utilized therein continuously repeats the same angles of incidence to the light source.

The solar-powered crystal display disclosed in the '850 patent utilizes a configuration in which the rotating crystal is mounted above a generally rectangular box having a top, bottom, front, rear, left and right sides. A portion of the top of the rectangular housing defines an inclined plane for mounting of a photovoltaic panel. The housing demonstrates a relatively low profile with substantially greater depth and length dimensions as compared to height. The drive motor and the output shaft of the '850 device are horizontally aligned in that they are mounted and positioned in a parallel relation to the top and bottom housing. The output shaft of the '850 motor utilizes a worm gear in order to engage a drive gear positioned upon the vertically aligned crystal drive shaft. Therefore, the '850 device presents a rather bulky, horizontally aligned housing upon which a vertically aligned crystal is rotated. Although such a design may have some utility in providing a stable base for placement upon, for example, a shelf or table, no other means is provided so as to enable optimal placement of said device upon a window. Certainly, the 3 dimensional configuration of the '850 device makes placement directly against a window—the typical portal for ambient light—rather cumbersome. It would be highly advantageous if a crystal display device could be provided demonstrating a substantially reduced depth—a flattened profile—as well as a means of affixing same directly to a window with minimum interference with the operation of blinds, shades or other window light control means.

SUMMARY OF THE INVENTION

Now, in accordance with the present invention, a crystal display device is disclosed. The devise is comprised of a main (or central) device housing wherein an electric motor and transmission means is positioned. The device further comprises a photovoltaic panel and a refractory crystal. The three afore-mentioned device components, the photovoltaic panel, main housing and crystal, are arranged in a substantially linear manner with, as described below, the panel located in a superior position, the main housing in a intermediate position, and the refractory crystal in an inferior position (suspended below the housing).

It is preferred to design and configure the device housing in the shape of, for example, of a generally flattened hollow cylinder having a front and rear planar surface, as well as a circumferential peripheral surface. The peripheral circumferential surface may be described as having upper and lower portions thereof relative to the orientation of the housing when the device is vertically mounted upon a window for proper function. As discussed in further detail below, when the device is positioned for use, the below-described window mounting means positions the front and rear planar surfaces of the housing substantially parallel in regard to a window pane upon which the device is mounted—the front planar surface of the housing facing and parallel to a planar surface of the window while the rear surface faces the room in which the device is utilized—. However, it is also contemplated that the housing may be of any other hollow geometric shape as long as the housing includes two opposing planar surfaces, the distance between which (the depth of the unit) is substantially less than the height or width thereof. It is highly advantageous to form the main housing of a transparent material such as, for example, a plastic, so as to reduce interference with light transmitted to or from the device as well as to provide visualization of the components therewithin.

A photovoltaic panel mounting means extends from the main housing, proximal to the upper portion thereof. In addition, a crystal drive shaft mounting means extends from the lower peripheral surface of the housing and a device window mounting means extends from the front planar surface (towards a window upon which the device is to be mounted). The photovoltaic mounting means may, in certain preferred embodiments, be advantageously formed as a contiguous extension of the main device housing.

An electric motor positioned within the housing includes an output shaft. The electric motor is powered by means of a photovoltaic panel (and electric leads arising therefrom) mounted upon and above the upper surface of the main device housing. The panel is selected to include photovoltaic cells of a capacity as to provide voltage, in the presence of sunlight of sufficient intensity, to power the electric motor and thereby rotate the motor output shaft.

A transmission means positioned within the device housing is especially configured and adapted so as to engage an output gear located upon the motor output shaft and thereby transfer rotational force provided by the motor to a crystal drive shaft gear for rotation of the crystal suspended therebelow. A crystal drive shaft, positioned and retained within the crystal drive shaft mounting means includes a drive shaft gear mounted upon a superior terminus thereof. The drive shaft mounting means utilizes collets, clips, bushings, bearings or other like means in order to position and retain the drive shaft gear in functional engagement with a final output gear of the transmission. The external surface of the main device housing may form, as an integral part thereof, an extension comprising the crystal drive mounting means.

The crystal drive shaft preferably includes a means of engaging a crystal suspension means such as, for example, a bore located proximal to an inferior terminus thereof so as to engage and retain a crystal suspension means such as, for example, a natural or synthetic line, string, cord or metal hook. The crystal drive shaft may also be provided with a loop, detent, groove, clip or prong as an engagement means for the crystal suspension means.

The suspension means, such as, for example, a metal hook is utilized to suspend, and transmit rotation to a multi-faceted, bilaterally symmetric crystal capable of refracting sunlight into a multicolored displays projected therefrom when the crystal is exposed to sunlight.

As discussed above, the crystal display device of the present invention is configured in a generally linear manner. That is to say that the photovoltaic panel, housing and crystal are arranged in a generally linear and vertical arrangement.

In a first preferred embodiment of the present invention, the main housing shaped and configures as what may be best described as a flattened cylindrical case. The electric motor is oriented within the cylindrical housing so that a drive shaft providing torsional power therefrom is aligned in a perpendicular relation in regard to the front and rear planar surfaces of the cylinder while the motor drive gear mounted upon said shaft is accordingly oriented in a parallel relationship with the front and rear surfaces of the housing.

The transmission of the first preferred embodiment of the present invention is comprised of a plurality of gears in order that the crystal drive shaft rotates at a far slower rate (rpm) and increased torque as compared to the speed and torque provided by the motor output shaft. Reduction of rotational speed allows the device, as described below, to project rainbow and other multi-color patterns that move slowly along walls and/or ceilings while the concurrent increase in torque allows the relatively small current provided by the photovoltaic cell to rotate the crystal. Thus transmission gear sizing and count is especially configured to optimize power and reduce speed. It is preferred that the crystal is rotated at a rate of from about 1 to about 3 rpm. It is well known in the art how to configure and select gears so as to provide such control of torque and speed. It is however, highly advantageous to arrange the transmission utilized in the present invention so that each of the gears therein are aligned parallel (as is the motor drive gear) relative to the front and rear of the cylindrical housing. Thus, the planar surface defined by each of said gears will be, generally, in parallel alignment with the planar surfaces described by the front and rear surfaces of the device housing. In this manner, the main housing may be configured to include minimal depth. A minimal depth housing positioned in the aforementioned manner allows unobtrusive mounting of the device, via suction cup or other means (such as, for example, adhesive strips, velcro, or mechanical hooks), to or along window surfaces without presenting undue interference to shade or blind operation. It is also contemplated that lines, strings and cords, comprised of any suitable synthetic or natural material, may be utilized to mount the device—via suspension—utilizing attachment points located on a superior surface of the solar panel to suspend the device from a fixation point above the device. Such attachment points may be configured in any manner suitable so as to form point for fixation of the line, cord or string such as, for example, a clip, strut, bore or cleat.

As discussed above, the top of the main housing advantageously includes—or is integral and contiguous with—a means of mounting a photovoltaic panel. It is most advantageous for said mounting means to orient said panel at an angular relationship of from about 30 to 60 degrees from the planar surface defined by the front and rear surfaces of the housing. It is still further advantageous to utilize an adjustable mounting means such as, for example, a hinge means so as to allow the photovoltaic panel to be more accurately positioned perpendicular to incident sunlight so that the photovoltaic cells therewithin can be positioned in accordance with the elevation of the sun. Therefore, the present invention contemplates the use and incorporation of embodiments utilizing fixed as well as variable panel mounting means.

The photovoltaic panel is comprised of a plurality of photovoltaic cells contained within a transparent panel. The panel is selected to provide a sufficient amount of current so as to power the electric motor for rotation of the refractive crystal. Conductive wiring is provided to transmit voltage from the photovoltaic cell to the electric motor through the panel mounting means.

A crystal drive shaft mounting means is provided proximal to the bottom surface of the cylindrical housing. The mounting means may be comprised of an extension of the housing itself and includes a bushing, collar, collet, clip or other axil retaining devices, all of which are well known to the art, in order to position and retain a crystal drive shaft extending vertically there through. More specifically, the drive shaft mounting means retains the crystal drive shaft so that teeth of a crystal drive gear located on a superior terminus thereof is positioned aligned and mated with teeth of a final output gear of the afore-mentioned transmission.

The crystal drive shaft, at an inferior terminus thereof, is provided with a coupling/engagement means in order to affix and retain the suspension means from which the refractory crystal is suspended below the device. For example, the drive shaft may advantageously include a diametric bore located in close proximity to the inferior terminus of the shaft. A refractory crystal may also exhibit a bore located proximal to the circumference thereof. Thus, a metal, wire, or, a synthetic or natural line, string or cord or metal hook may be utilized to transmit rotational force, provided by the electric motor and thereafter transferred to the crystal drive shaft by means of the above-described transmission to the crystal for rotation thereof. Since the refractory crystal is not held in a fixed orientation in relation to the housing, but is suspended below in a manner similar to a plumb line, slight deviations in device placement will not interfere with a true vertical position of the crystal.

The refractory crystal is selected to be multi-faceted and to be bilaterally symmetrical. However, in certain preferred embodiments of the present invention, the crystal is also selected to demonstrate a somewhat flattened (cross section), as opposed to axially symmetrical shape. Thus, unlike multi-faceted crystals which demonstrate an axially symmetrical shape—a shape in which the crystal demonstrates complete symmetry along its longitudinal axis—the relatively flat crystal utilized in certain preferred embodiments of the present invention varies the angle of incidence between ambient sunlight and the crystalline facets. The ever changing angle of incidence allows refractory patterns such as, for example, rainbows produced by the device, to advance more effectively along a wall or other surface as the crystal rotates.

The front surface of the housing includes a means for mounting a surface engagement means. For example, the front surface of the housing may include clips, slots, adhesives, screws or bolts for retaining for example, a suction cup oriented so as to engage a vertical window surface in a parallel relationship with the planar front (and rear) surface of the housing. Such a mounting means is utilized to affix the device to a window in such a manner so that the photovoltaic panel is positioned superior to the housing and facing the window (thereby receiving light passing there through.) Fabric hook and loop adhesive coated strips may be also utilized to affix the device directly to and upon a window without the use of any other mounting means. In certain alternative preferred embodiments of the present invention, the device is mounted via suspension. More specifically, it is contemplated that an alternative preferred embodiment of the present invention utilizes attachment means, located on a superior surface of the photovoltaic panel, for fixation of a suspension line, cord or string, comprised of any suitable synthetic material. The attachment means may be configured as, for example, a clip, cleat, strut or bore for receipt and attachment of the line, cord or string which, in turn, is affixed to a point above the device.

As discussed above, the refractory crystal is suspended below the unit after the device has been properly vertically oriented and affixed to a window. In a preferred embodiment of the present invention, the crystal drive shaft mounting means which extends from the bottom of the housing is advantageously positioned proximal to the rear surface of the housing so as to provide sufficient clearance for the rotations thereof.

DETAILED DESCRIPTION

Figure 1:
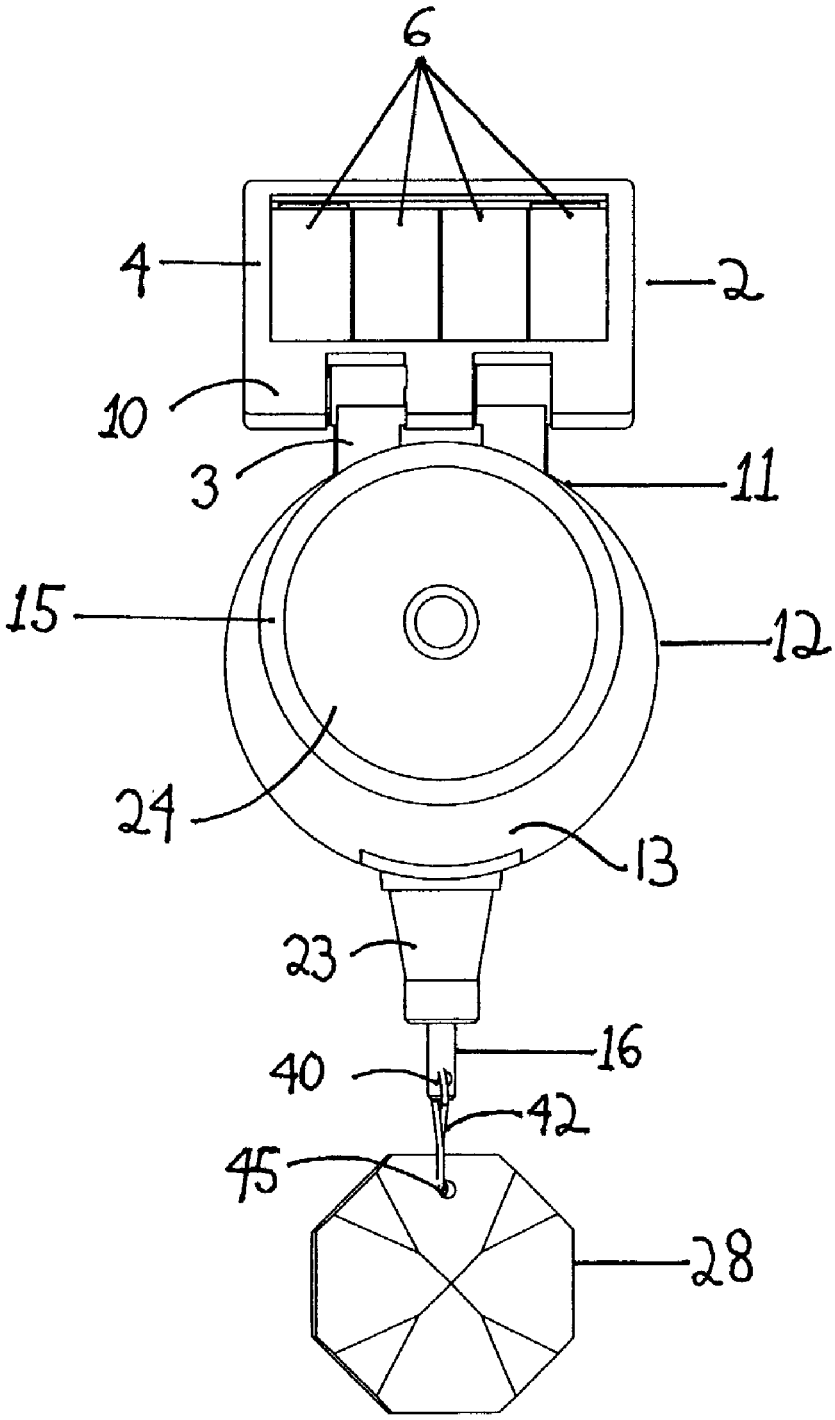
FIG. 1 is a frontal view of a preferred embodiment of the present invention
Figure 2:
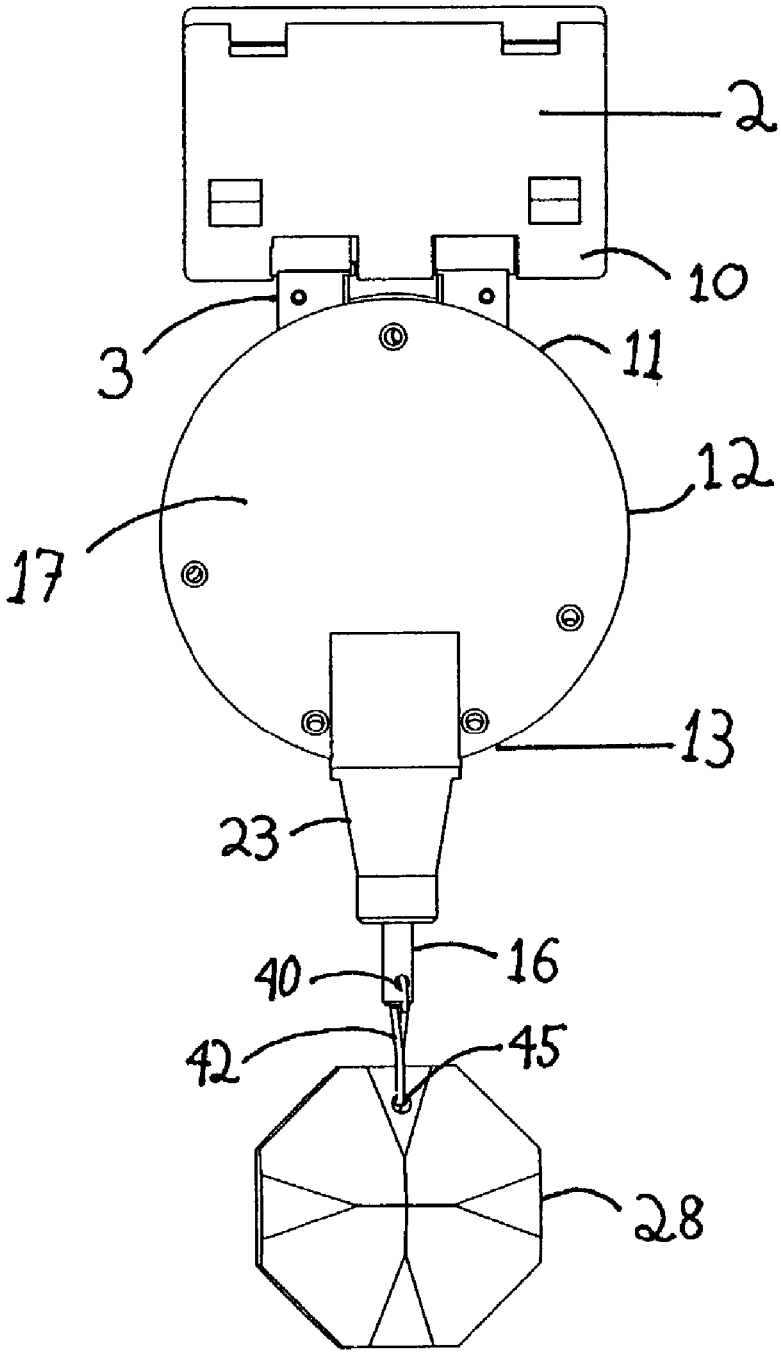
FIG. 2 is a rear view of a preferred embodiment of the present invention
Figure 3:
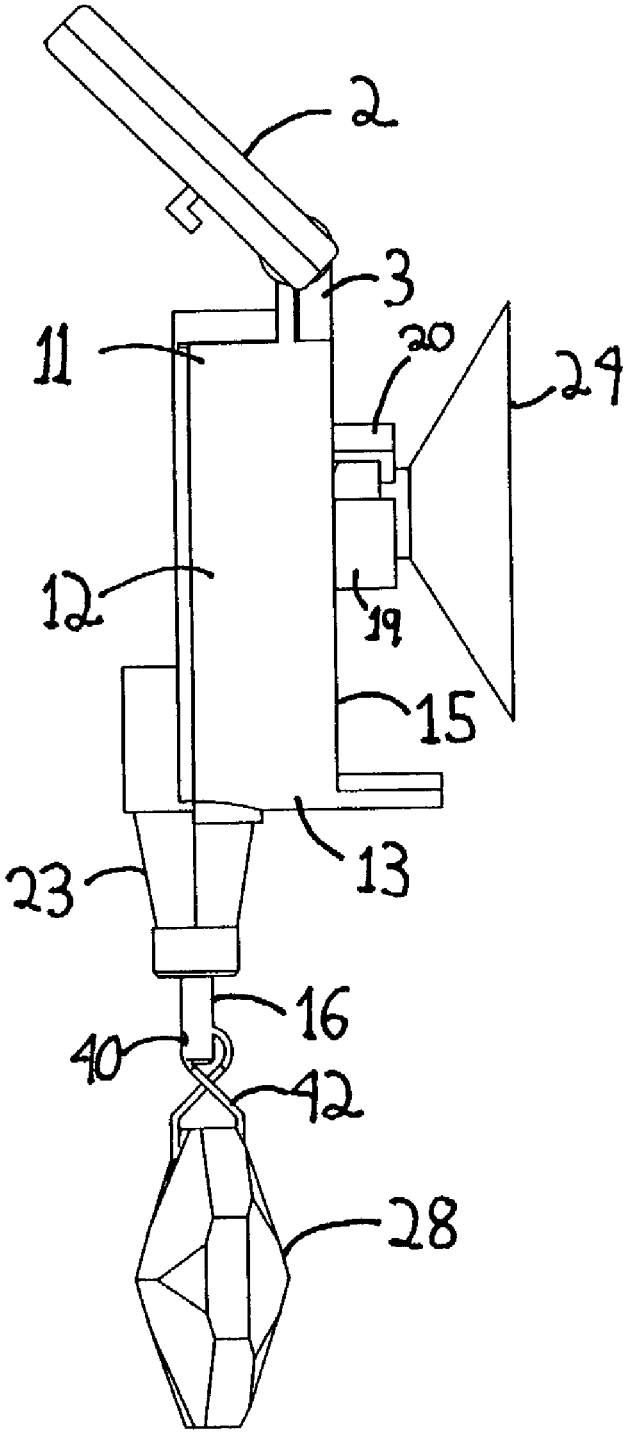
FIG. 3 is a side view of a preferred embodiment of the present invention.
Figure 4:
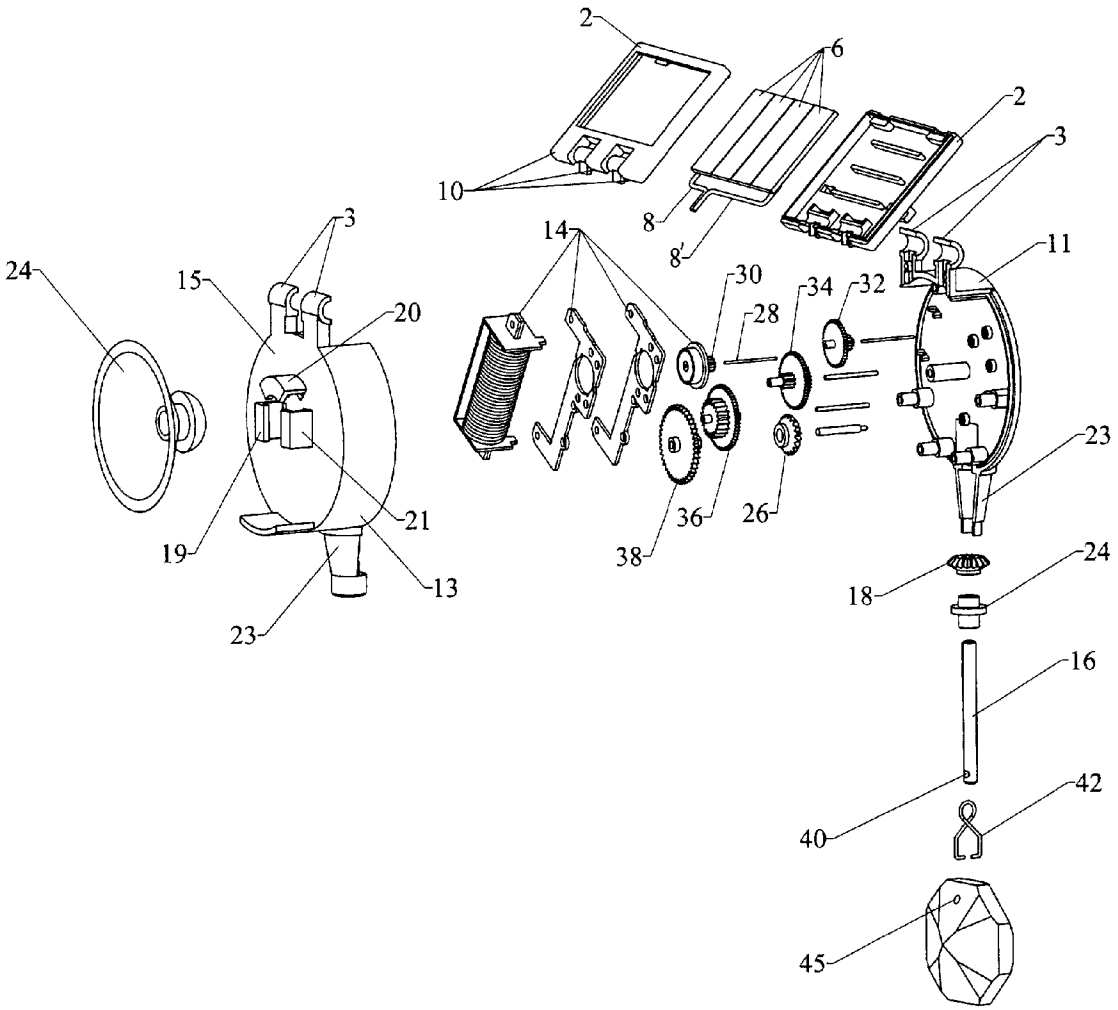
FIG. 4 is a front lateral exploded view of a preferred embodiment of the present invention.
Figure 5:
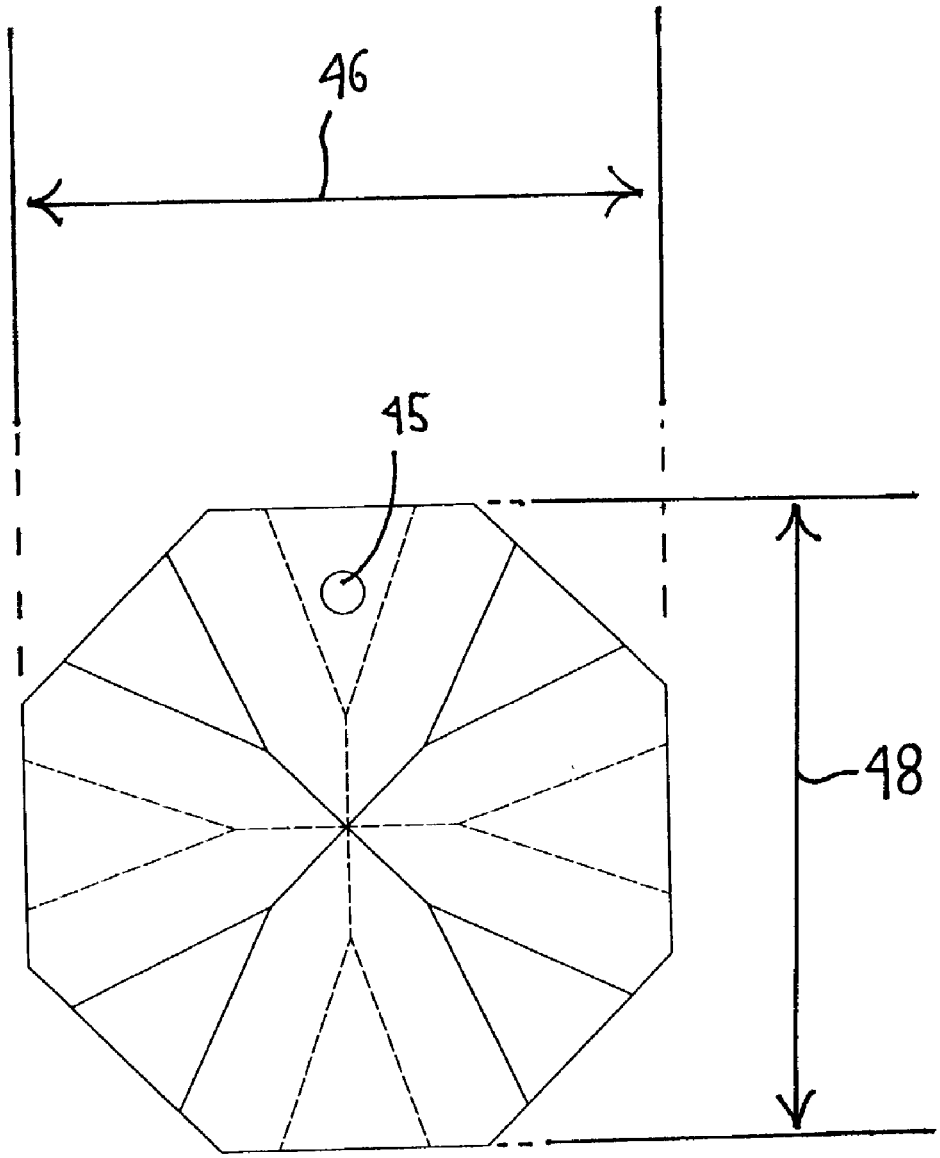
FIG. 5 is a sagittal view of the refractory crystal illustrated in FIGS. 1–4.
Figure 6:
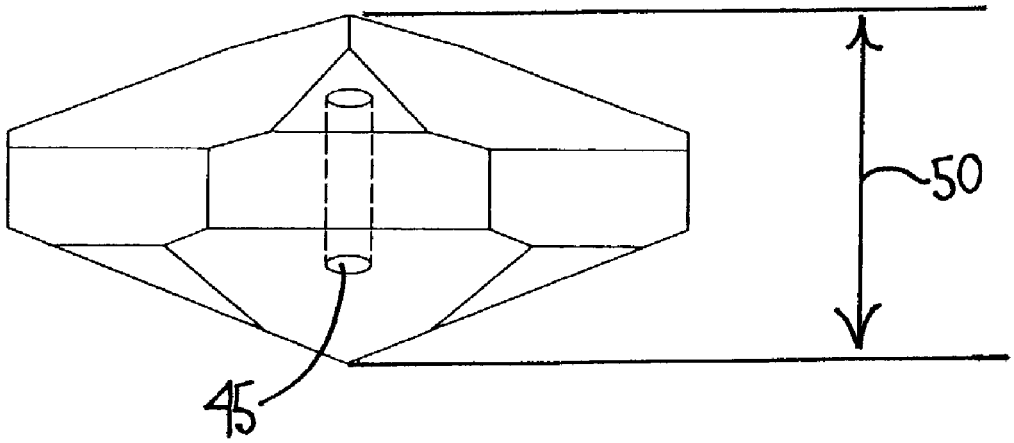
FIG. 6 is an axial view of the refractory crystal illustrated in FIGS. 1–4.

FIG. 1, FIG. 2 and FIG. 3 illustrate a preferred embodiment of the present invention incorporating the afore-mentioned vertical device configuration. Therefore the photovoltaic panel 2, main device housing 12 and refractory crystal 28 suspended therebelow are arranged in a substantially linear and, when positioned upon a window surface, vertical orientation for proper device function.

Photovoltaic panel 2 is comprised of panel housing 4, photovoltaic cells 6 and electric power leads 8 and 8'. The housing is advantageously selected to be formed of a transparent material so as to maximize exposure of the photovoltaic cells therein to incident sunlight. The photovoltaic panel is selected so as to provide an electric current of sufficient amperage and voltage so as to power the above and below-described electric motor. A suitable example of such a photovoltaic panel is the "Amorphous Silicon Solars" panel manufactured by M/s.ZhuHai Dao Yuan Scientific Technology Development Company, LTD, of ZhuHai City, China . This panel produces an electric current of approximately 2 milliamps at a maximum output voltage of 3 volts. However, any photovoltaic panel capable of supplying sufficient power to operate the electric motor of the present invention when exposed to sunlight of sufficient intensity at the below-described rate is sufficient. The electric motor is selected to be of a substantially flat design so as to require minimal distance between the front and rear surface of the main device housing. Furthermore, it is highly advantageous to utilize and electric motor that produces sufficient output torque and rpm from relatively low voltage—about 1 to 4 volts with a drive shaft rpm of from about 400 to about 500 rpm. The photovoltaic panel illustrated in FIG. 1, FIG. 2 and FIG. 3 includes, as an integral part of the housing thereof, a hinge portion 10 especially configured and adapted for coupling with the below described solar panel mounting means of the main device housing described below. The hinge may be set at a fixed or variable angle in order to allow the solar panel to be oriented substantially perpendicular to incident sunlight so as to maximize collection of photons therefrom. Thus it is contemplated that preferred embodiments of the present invention may utilize fixed, or variable panel mounting means. The hinge portion 10 also provides a conduit for electric power leads 8 and 8' from the photovoltaic cells to the housing (and on to the electric motor therein).

The main device housing 12 encases an electric motor 14 which receives electric power via the aforementioned power leads 8 and 8' from the photovoltaic cell there above. The main device housing, which, in the preferred embodiment illustrated in FIGS. 1, 2 and 3, may be advantageously formed in the shape of a hollow flattened cylinder. The main housing includes an upper portion 11, a lower portion 13, a front planar surface 15 and a rear planar surface 17. The front surface 15 is ordinarily positioned against so as to face an outside window exposed to sunlight. Therefore, the front surface of the main housing includes a device window mounting means. In the preferred embodiment of the present invention illustrated in FIGS. 1, 2 and 3, the window mounting means is comprised of integral clips 19, 20 and 21 especially designed, configured and adapted to retain suction cup 24 which is utilized to affix the device to an inside surface of a selected window surface. The suction cup is utilized to position and retain the device to the inside surface of a window as well as to orient the device in the aforementioned vertical array so that the photovoltaic panel is in the most superior position, main device housing is in a central position and refractory crystal hangs below the device.

As mentioned above, the main device housing also includes a photovoltaic panel mounting means which, in the preferred embodiment illustrated in FIGS. 1, 2 and 3 is comprised of hinge extension 3. Hinge extension 3 is mated and adapted for receipt of hinge portion 10 of the photovoltaic cell housing so as to allow positioning of the panel in such a manner as to allow the photovoltaic cells therein to be substantially perpendicular to incident sunlight. The hinge may of a fixed or variable design so as to allow the panel to be adjusted in accordance with solar elevation.

The main device housing also includes a crystal drive shaft mounting means 23 extending from the bottom surface thereof. The crystal drive shaft mounting means may be advantageously formed and designed to include a collet 10, collar, bushing or clip as a means of retaining crystal drive shaft 16 and the crystal drive shaft gear 18 thereupon in contact and alignment so as to mesh with final transmission drive gear 26 while also affixing and preventing loss of the drive shaft from the main device housing and transmission therein. The crystal drive shaft gear 18 and final transmission drive gear 26 may advantageously utilize beveled gear so as to allow the gears to mesh at an approximately 90 degree angle thereby transferring torque from the horizontally aligned transmission to the crystal drive shaft.

The electric motor 14 includes a motor output shaft 28 with motor output gear 30 mounted thereupon. The motor output gear is advantageously coupled to a transmission in order to reduce the speed and increase the torque of the electric motor so as to provide the below-described crystal rotation speed as well as to provide sufficient torsional force to, in fact, rotate the crystal. In the transmission utilized and illustrated in the preferred embodiment of the present invention shown in FIGS. 1, 2 and 3, the gear teeth of motor output gear 30 mesh and engage with primary transmission gear 32 which likewise engages with intermediate transmission gear 34 which in turn meshes with intermediate gear 36. Intermediate transmission gear 36 meshes with final transmission gear 38 which in turn meshes with crystal drive gear 18, described below. Each of the afore-mentioned transmission gear is of a compound design being comprised of two separate gears of a larger and smaller diameter. Each successive gear, starting from the motor drive gear to the final transmission gear, receives torsional power the larger of its two compound gears and transmits power from its smaller diameter gear. Such a configuration is well known in the art to reduce rotational speed of the torque source—the drive motor gear—while increasing torque. In the present invention, such a configuration is advantageously utilized so as to insure that enough torque reaches the crystal drive shaft 18 in order to rotate the relatively great mass of the refractory crystal. At the same time, the reduced rpm provided by the transmission to the crystal drive shaft 18, allows colored displays generated by the crystal to move slowly enough along walls and other surfaces to be visualized and appreciated.

As described above, the electric motor, energized by the photovoltaic cells of the photovoltaic panel, generates rotational force which, delivered by the motor drive shaft and gear, is increased in torque, reduced in rpm and delivered to the crystal drive gear located proximal to a superior terminus of the crystal drive shaft. Proximal to an inferior terminus of the crystal drive shaft, a bore 40 is provided for affixing a crystal suspension means such as, for example, a hook 42, line, string, cord or other suspension material comprised of, for example, a natural or synthetic material. The suspension means is advantageously selected in order to allow the refractory crystal to freely hang below the device in the manner of a plumb line so as to maximize the projection of refracted light therefrom upon surfaces of a room in which it is located. The suspension of the crystal below the device also prevents the device itself from blocking or hindering the display emanating therefrom.

The refractory crystal 44 of the preferred embodiment illustrated in FIGS. 1, 2 and 3 includes a bore 45 located proximal to a peripheral edge thereof. The bore provides a point of attachment for hook 42 or any other suitable suspension means or material. The bore and suspension material are selected to be of a dimension and material so as to allow the crystal to hang freely enough to be plumb as opposed to a rigid attachment which might interfere with proper vertical alignment of the crystal. However, the suspension means must exhibit enough rigidity as to transfer rotational movement from the crystal shaft to the crystal.

The refractory crystal is advantageously selected to be of a multi-faceted bilaterally symmetric shape so that when viewed, as illustrated in FIGS. 1 and 2, the crystal exhibits right and left sides of equal dimensions (mirror images). The maximum width of the crystal 46 and height 48 are substantially greater than the crystals maximum depth 50. It is, in fact, highly advantageous for the crystal to include a maximum width that is at least 25 percent greater than the crystals maximum depth. Therefore, in certain preferred embodiments of the present invention, the refractory crystal includes an asymmetric cross sectional profile. The crystal thus, when suspended from the device presents a somewhat flattened profile as compared to axially symmetric crystals of prior art display devices. Such a relatively flat profile improves the movement of the colored images projected by the crystal as compared to axially symmetric devices in which the depth of the crystal is substantially the same as the crystals width. However, the present invention also contemplates embodiments wherein the refractory crystal demonstrates is axially symmetric—presents a symmetric cross-sectional configuration—The crystals are also selected to provide sufficient refractory properties as to project multi-colored displays when exposed to sunlight.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. A crystal display device comprised of:

a main device housing having a front planar, rear planar, top and bottom surface, said housing including a photovoltaic panel mounting means extending proximal to the top surface thereof, a crystal drive shaft mounting means extending proximal to the bottom surface thereof, and a device mounting means extending from the front planar surface thereof;

an electric motor positioned within the housing, said electric motor including an output shaft;

a photovoltaic panel affixed to and mounted above the main device housing, said panel providing sufficient current and voltage, in the presence of sunlight, to power said electric motor;

a transmission means positioned within the device housing especially configured and adapted so as to couple with and engage said motor output shaft and transfer rotational force provided thereby to rotate a refractory crystal suspended below the main housing, said transmission being comprised of a plurality of gears having planar surfaces, said gears being oriented and positioned with said planar surfaces substantially parallel relative to the front and rear planar surfaces of said main device housing;

a crystal drive shaft, positioned and retained proximal to the bottom surface of said main housing within said crystal drive shaft mounting means, said crystal drive shaft including a drive gear mounted upon a superior terminus thereof in functional engagement with said transmission;

a crystal suspension means; and a multi-faceted, bilaterally symmetric crystal suspended below the main device housing, wherein, when said device is exposed to sunlight the crystal rotates and projects moving and advancing, multi-colored images upon walls and other surfaces.

2. The crystal display device of claim 1 wherein the device mounting means comprises a suction cup affixed to the front surface of said main housing.

3. The crystal display device of claim 1 wherein the device mounting means comprises adhesive strips affixed to the front surface of said main housing.

4. The crystal display device of claim 1 wherein the device mounting means comprises hook and loop fabric fasteners affixed to the front surface of said main housing.

5. The crystal display device of claim 1 wherein said photovoltaic panel mounting means is comprised of a portion of the main device housing located proximal and extending from to the top surface thereof and a corresponding and matting portion of a housing encasing said photovoltaic panel extending from a bottom surface of said photovoltaic panel housing.

6. The device of claim 1 wherein said crystal drive shaft includes, proximal to an inferior terminus thereof, a bore for affixing said crystal engagement means.

7. The device of claim 1 wherein said crystal drive shaft includes, proximal to an inferior terminus thereof, an engagement means for affixing the crystal suspension means.

8. The device of claim 1 wherein said suspension means comprises a hook.

9. The device of claim 1 wherein said suspension means comprises a cord, string or fiber.

10. The device of claim 1 wherein said refractory crystal includes a bore located proximal to a peripheral edge thereof, for receipt and retention of said crystal suspension means.

11. The device of claim 1 wherein said refractory crystal has a maximum width that is at least 25 percent greater than the maximum depth thereof.

12. The device of claim 1 wherein the device housing comprises a hollow flattened cylinder.

13. The device of claim 1 wherein the mounting means is comprised of a suspension attachment means located upon a superior surface of the photovoltaic panel.

14. The device of claim 1 wherein the suspension attachment means is a clip, strut, cleat or bore.

15. The crystal display device of claim 5 wherein said extended portion of the main device housing and extended portion of the housing encasing the photovoltaic panel comprise a hinge configured so as to allow an angular relations ship of said photovoltaic panel with the main device housing to be adjusted for optimal reception of sunlight by said photovoltaic panel.

16. The crystal display device of claim 5 wherein said extended portions of said main device housing and photovoltaic panel housing are joined at a predetermined and fixed angular relation.

17. The device of claim 7 wherein said engagement means comprises a bore, groove or loop.

18. A crystal display device comprised of:

a main device housing having a front planar, rear planar, top and bottom surface, said housing including a photovoltaic panel mounting means extending proximal to the top surface thereof, a crystal drive shaft mounting means extending proximal to the bottom surface thereof, and a device mounting means extending from the front planar surface thereof;

an electric motor positioned within the housing, said electric motor including an output shaft;

a photovoltaic panel mounted to and above the top surface of said main housing providing sufficient current and voltage, in the presence of sunlight, to power said electric motor;

a transmission means positioned within the main device housing especially configured and adapted so as to couple with and engage said motor output shaft and transfer rotational force provided thereby to a refractory crystal suspended below said housing, said transmission being comprised of a plurality of gears having planar surfaces, said gears being oriented and positioned with said planar surfaces substantially parallel relative to the front and rear planar surfaces of said main device housing;

a crystal drive shaft, positioned and retained within said crystal drive shaft mounting means, said crystal drive shaft including a drive gear mounted upon a superior terminus thereof in functional engagement with said transmission;

a crystal suspension means; and a multi-faceted, bilaterally symmetric refractory crystal having a maximum depth at least 25 percent less than maximum width suspended below said main device housing wherein when said device is exposed to sunlight, the crystal projects moving and advancing, multi-colored images generated by refraction of said light upon walls and other surfaces.

19. The crystal display device of claim 18 wherein the device mounting means comprises a suction cup affixed to the front surface of said device.

20. The crystal display device of claim 18 wherein said photovoltaic panel mounting means is comprised of an extended portion of the main device housing located proximal to the top surface of said device housing and a corresponding and matting portion comprised of an extending from the bottom surface of a housing encasing said photovoltaic panel.

21. The device of claim 18 wherein said crystal drive shaft includes, proximal to an inferior terminus thereof, a means of affixing said suspension means.

22. The device of claim 18 wherein said crystal suspension means is a hook, line, string or cord.

23. The device of claim 18 wherein said refractory crystal includes a bore located proximal to a peripheral edge thereof, for receipt and retention of said crystal engagement means.

24. The device of claim 18 wherein the mounting means is comprised of a suspension attachment means located upon a superior surface of the photovoltaic panel.

25. The device of claim 24 wherein the suspension attachment means is a clip, strut, cleat or bore.

26. The crystal display device of claim 20 wherein said extended portions of said main device housing and photovoltaic panel comprise a hinge and are configured so as to allow an angular relations ship of said photovoltaic panel with the main device housing to be adjusted for optimal reception of sunlight by said photovoltaic panel.

27. The crystal displace of claim 20 wherein said extended portions of the main device housing and photovoltaic panel are affixed to each other at a predetermined and fixed angular relation.

28. The device of claim 21 wherein said means of affixing said suspension means is a bore, groove or loop.

29. The device of claim 22 wherein said suspension means is fabricated of metal.

30. The device of claim 22 wherein said suspension means is fabricated of a natural or synthetic fiber.

* * * * *